US011184697B2

(12) United States Patent
Iseberg

(10) Patent No.: US 11,184,697 B2
(45) Date of Patent: Nov. 23, 2021

(54) CONFORMABLE SEALING EARTIP

(71) Applicant: Team IP Holdings, LLC, Fort Worth, TX (US)

(72) Inventor: Steve Iseberg, Crystal Lake, IL (US)

(73) Assignee: Team IP Holdings, LLC, Fort Worth, TX (US)

( * ) Notice: Subject to any disclaimer, the term of this patent is extended or adjusted under 35 U.S.C. 154(b) by 0 days.

(21) Appl. No.: 16/735,911

(22) Filed: Jan. 7, 2020

(65) Prior Publication Data

US 2020/0221206 A1 Jul. 9, 2020

Related U.S. Application Data

(60) Provisional application No. 62/789,333, filed on Jan. 7, 2019.

(51) Int. Cl.
*H04R 1/10* (2006.01)

(52) U.S. Cl.
CPC ..... *H04R 1/1016* (2013.01)

(58) Field of Classification Search
CPC .. H04R 1/105; H04R 1/1008; H04R 2460/13; H04R 1/1066; H04R 2460/15; H04R 5/033; H04R 2225/0213; H04R 2225/0216; H04R 2225/67; H04R 25/60; H04R 25/652; H04R 25/656; H04R 25/70; H04R 2225/025; H04R 5/0335; H04R 1/1016; A61F 11/08; A61F 2007/0005
See application file for complete search history.

(56) References Cited

U.S. PATENT DOCUMENTS 5,113,967 A * 5/1992 Killion ..... A61F 11/08 181/132
2005/0087195 A1* 4/2005 Huang ..... A61F 11/08 128/864
2005/0274568 A1* 12/2005 Falco ..... A61F 11/08 181/135
2008/0187159 A1* 8/2008 Blanchard ..... A61F 11/08 381/328
2011/0036661 A1* 2/2011 Munro ..... A61F 11/08 181/135
2011/0268308 A1* 11/2011 Vasquez ..... H04R 1/1016 381/380
2012/0090626 A1* 4/2012 Chen ..... A61F 11/08 128/864
2020/0077173 A1* 3/2020 Wexler ..... H04R 1/1058

* cited by examiner

*Primary Examiner* — Akelaw Teshale
(74) *Attorney, Agent, or Firm* — McAndrews, Held & Malloy, Ltd.

(57) ABSTRACT

Conformable sealing eartips having ribs formed on an interior surface of one or more eartip flanges are provided. The eartip may include a body and one or more flanges. The body may include an ear insertion end, an earphone insertion end opposite the ear insertion end, and a central opening extending between the ear insertion end and the earphone insertion end to form an inner sound channel through the body. The one or more flanges may extend from the body and may include an outer sealing surface and an inner surface. At least one of the one or more flanges may include a plurality of ribs protruding from the inner surface of the at least one of the one or more flanges.

17 Claims, 11 Drawing Sheets

CONFORMABLE SEALING EARTIP

CROSS-REFERENCE TO RELATED APPLICATIONS/INCORPORATION BY REFERENCE

The present application claims priority under 35 U.S.C. § 119(e) to U.S. Provisional Patent Application No. 62/789,333, filed Jan. 7, 2019, entitled "CONFORMABLE SEALING EARTIP." The above referenced provisional application is hereby incorporated herein by reference in its entirety.

FIELD

The present disclosure relates to earphone and earplug eartips. More specifically, the present disclosure relates to conformable sealing eartips having ribs formed on an interior surface of one or more eartip flanges.

BACKGROUND

There are many styles of eartips found on commonly available earphones and earplugs, typically comprised of a foam or elastomer material. The particular characteristics of the material used, such as durometer or density, have a significant impact on the ability of the eartip to conform to the individual ear canal, the comfort reported by the user of the eartip, and the isolation from external sound. The particular design of the eartip can have an even greater impact on its ability to conform to the ear canal, its comfort for the user, and its tendency to create a hermetic seal to the ear canal, which may affect the ability to achieve the desired external sound isolation.

Existing eartips may cause discomfort for a variety of reasons. One factor causing discomfort when using existing eartips is pressure on the ear canal or tympanic membrane caused by the eartip unyieldingly sealing to the ear canal wall as the eartip is inserted deeper into the ear canal. Another factor causing discomfort includes pressure applied to the ear canal by the eartip material being less yielding than the ear canal as the eartip tries to return to its nominal shape. For example, foam eartips are typically compressed before insertion. Once inserted, the foam eartip attempts to recover to its pre-compressed shape, which applies pressure to the ear canal that may cause discomfort.

An additional factor causing discomfort when using existing eartips is unyielding shapes or materials. For example, edges of sealing flanges can cause discomfort as the eartip relaxes to its nominal shape after insertion, causing the edge of the sealing flange to settle into the ear canal wall. The more difficult it is to seal the eartip to the ear canal, the more likely the eartip will cause discomfort. There are many existing eartip designs that require the users' ear canal to conform to the eartip in order to create a seal, rather than the eartip conforming to the users' ear canal, causing immediate and/or eventual discomfort with use of the device. Another factor causing discomfort includes eartip designs that require deep insertion to create a seal to the ear canal wall. The placement of the eartip deep in an ear canal of the user may be uncomfortable for some users.

Further limitations and disadvantages of conventional and traditional approaches will become apparent to one of skill in the art, through comparison of such systems with some aspects of the present disclosure as set forth in the remainder of the present application.

SUMMARY

Certain embodiments of the present technology provide conformable sealing eartips having ribs formed on an interior surface of one or more eartip flanges, substantially as shown in and/or described in connection with at least one of the figures.

These and other advantages, aspects and novel features of the present disclosure, as well as details of an illustrated embodiment thereof, will be more fully understood from the following description and drawings.

DETAILED DESCRIPTION

Figure 1:
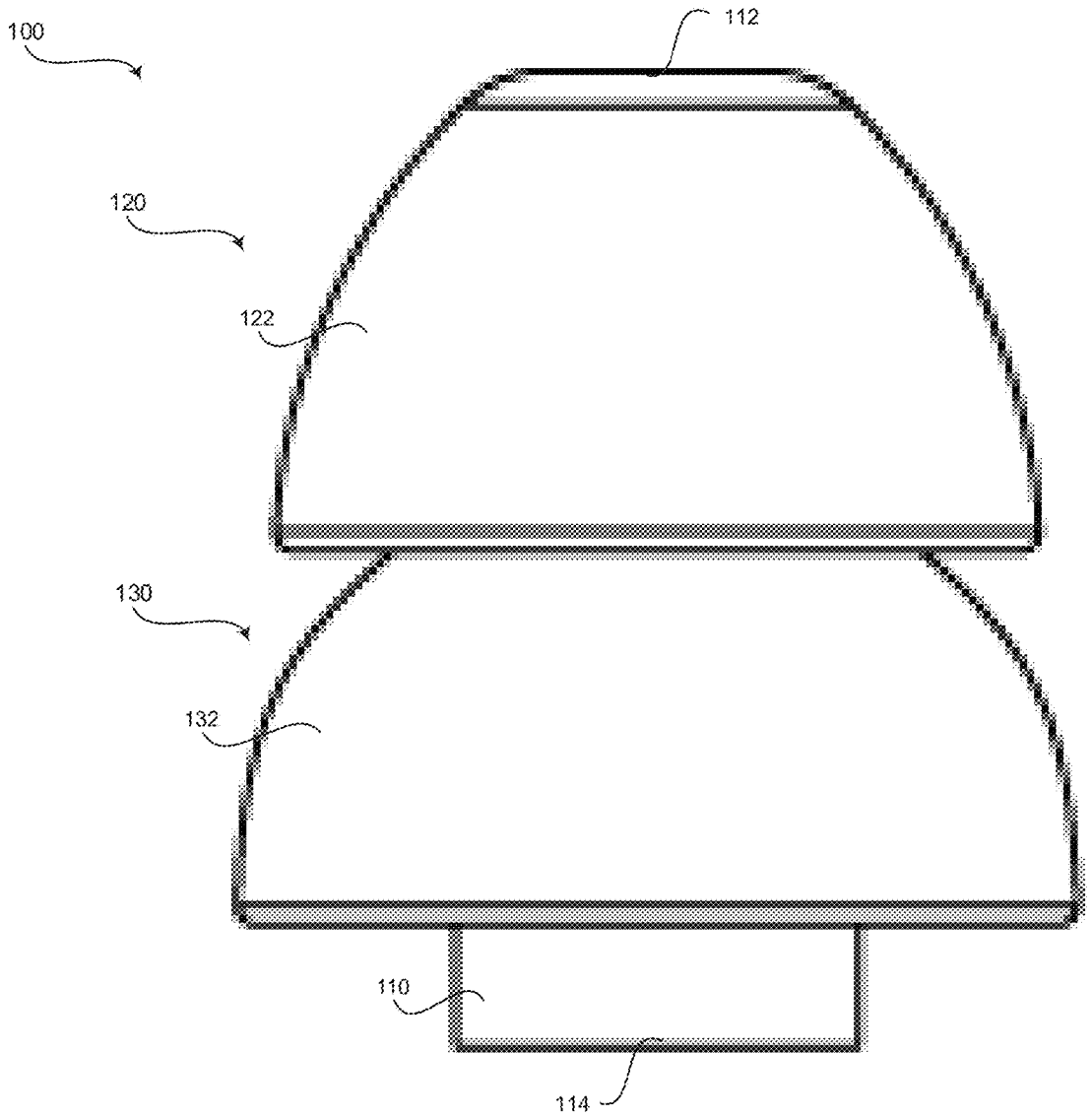
FIG. 1 depicts a side elevation view of an exemplary two-flange conformable sealing eartip having ribs formed on an interior surface of one or both of the flanges, in accordance with various embodiments.
Figure 2:
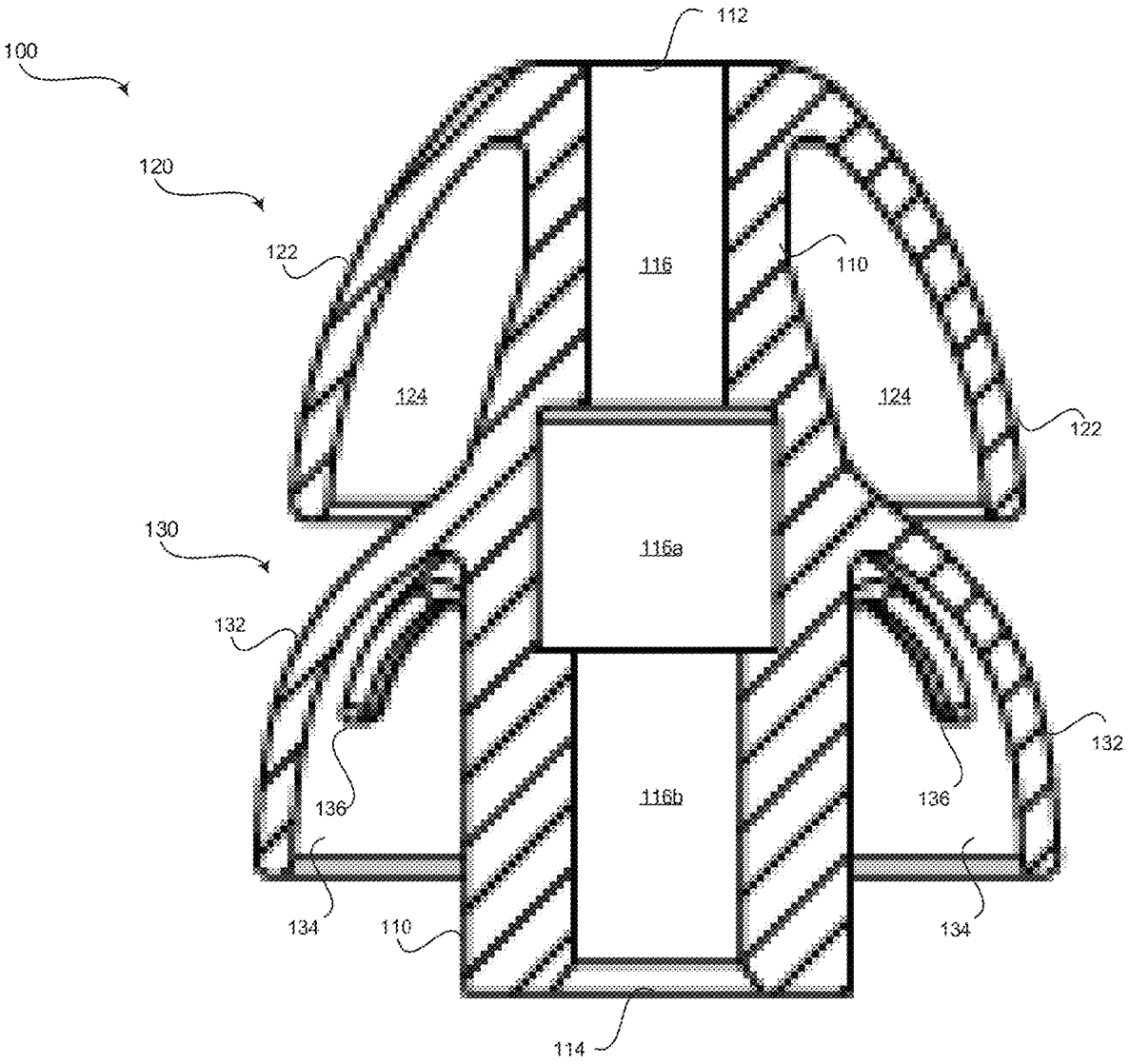
FIG. 2 depicts a side cross-sectional view of an exemplary two-flange conformable sealing eartip having ribs formed on an interior surface of the rear flange, in accordance with various embodiments.
Figure 3:
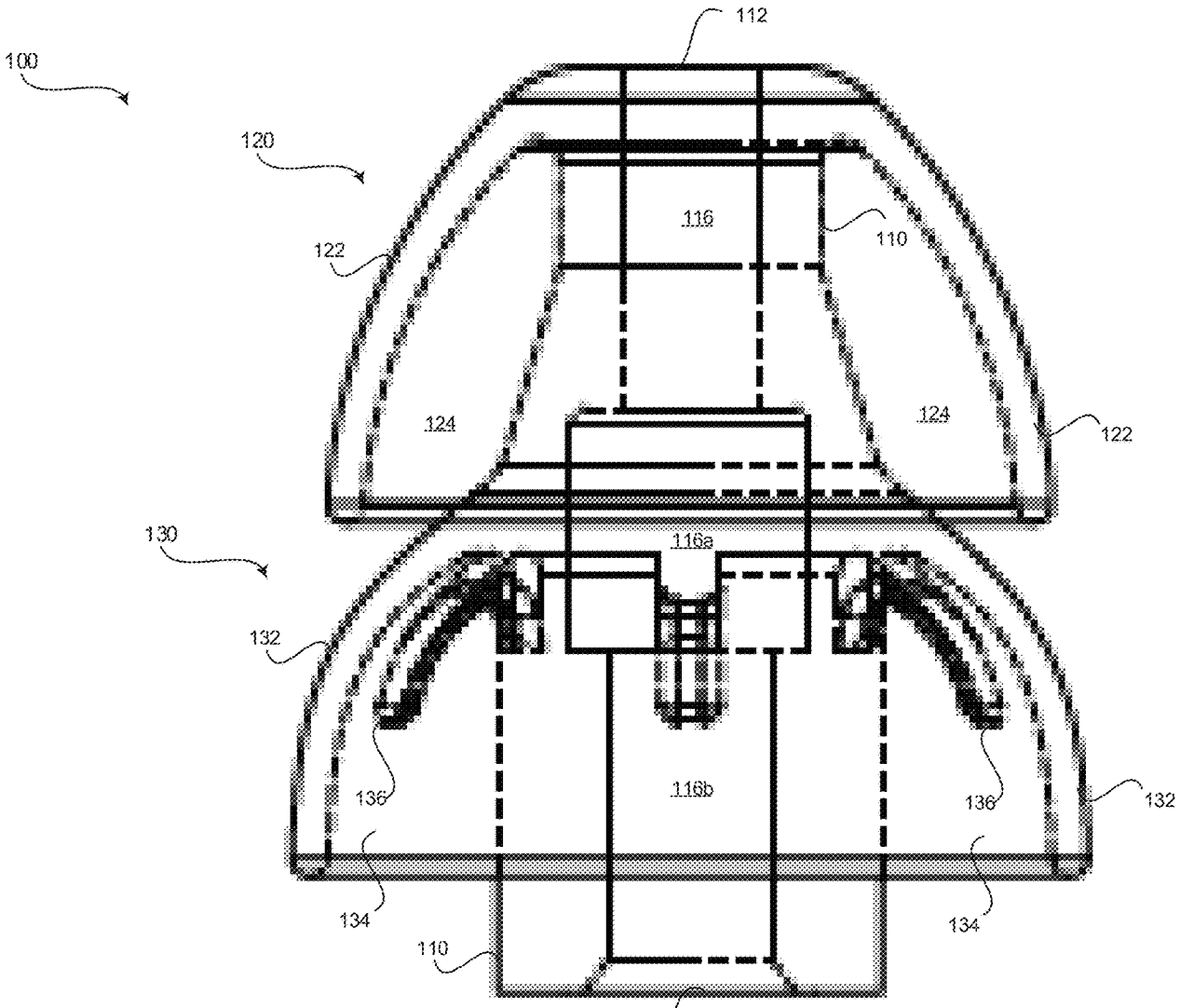
FIG. 3 depicts a semi-transparent side elevation view of an exemplary two-flange conformable sealing eartip having ribs formed on an interior surface of the rear flange, in accordance with various embodiments.
Figure 4:
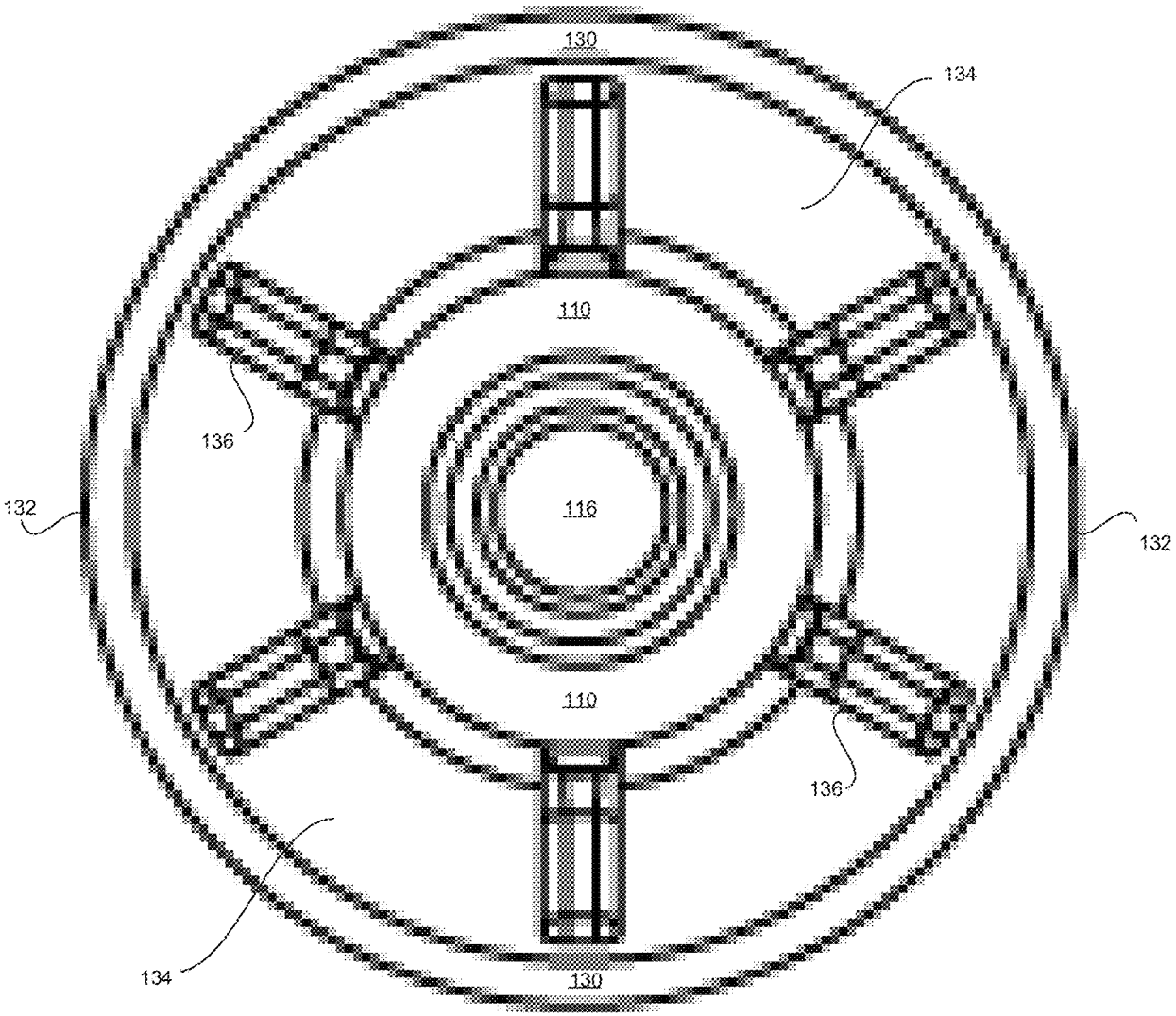
FIG. 4 depicts a bottom elevation view of an exemplary two-flange conformable sealing eartip having ribs formed on an interior surface of one or both of the flanges, in accordance with various embodiments.
Figure 5:
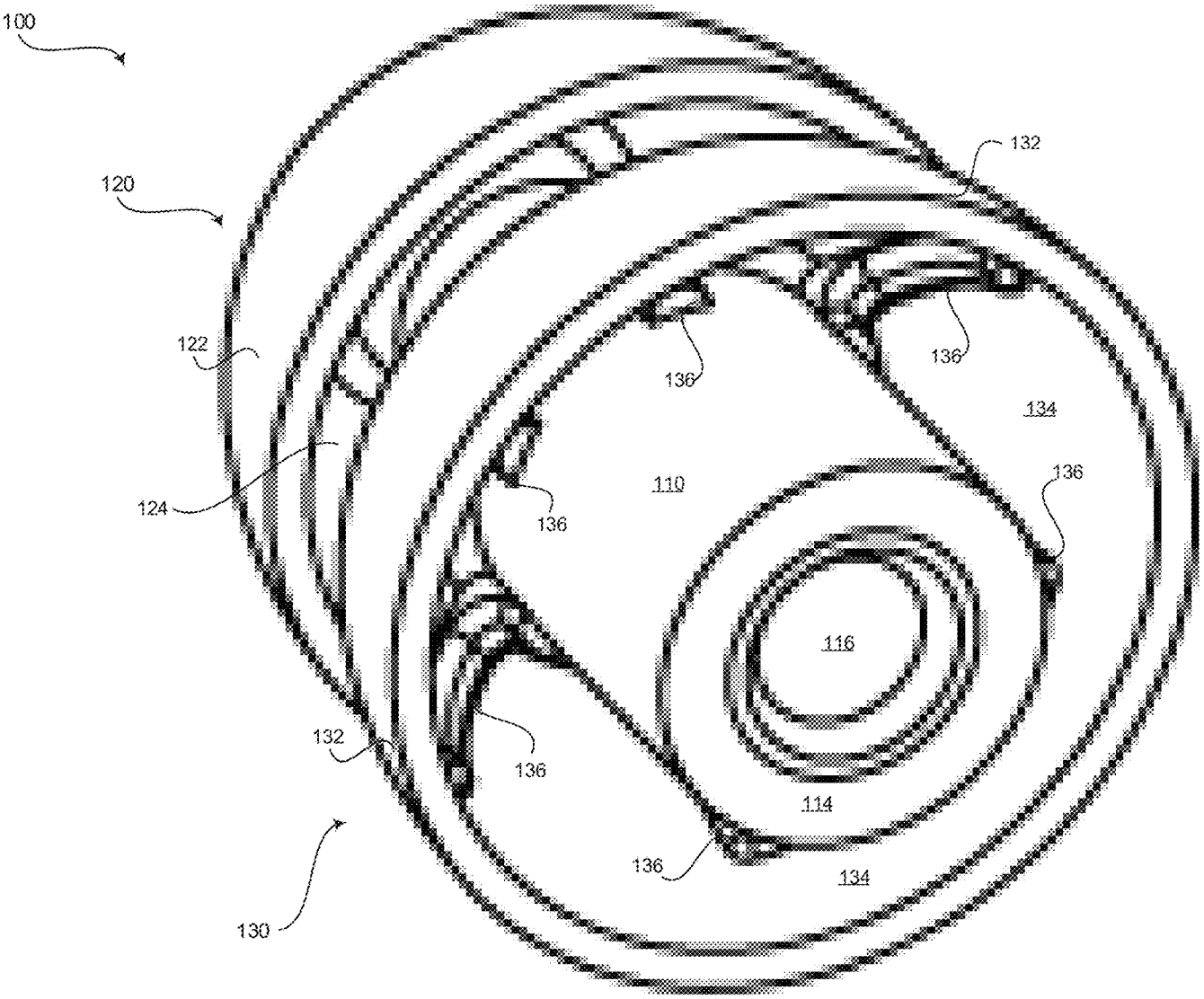
FIG. 5 depicts a bottom, side perspective view of an exemplary two-flange conformable sealing eartip having ribs formed on an interior surface of the rear flange, in accordance with various embodiments.
Figure 6:
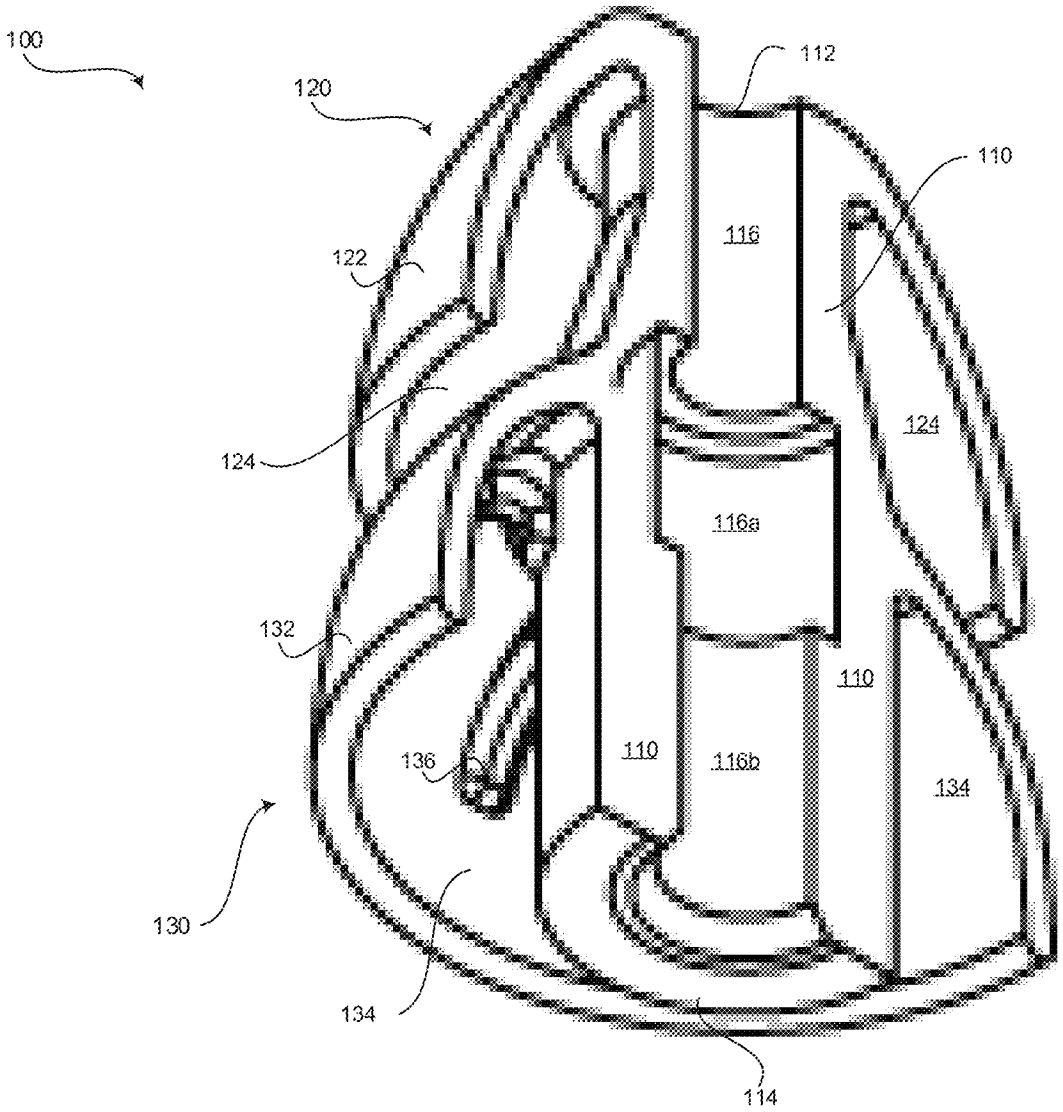
FIG. 6 depicts a bottom, side perspective view of a cross-section of an exemplary two-flange conformable sealing eartip having ribs formed on an interior surface of the rear flange, in accordance with various embodiments.

Embodiments of the present technology provide an eartip that can conform comfortably to the individual ear canal while easily creating and maintaining one or two sealing surfaces to the wall of the ear canal. Aspects of the present disclosure integrate a low-durometer (i.e., in the range of 25 to 45 Shore A) elastomer into a design that is highly conformable but with enough integrity in its shape to create and maintain a seal to the ear canal wall.

The foregoing summary, as well as the following detailed description of certain embodiments will be better understood when read in conjunction with the appended drawings. It should be understood that the various embodiments are not limited to the arrangements and instrumentality shown in the drawings. It should also be understood that the embodiments may be combined, or that other embodiments may be utilized and that structural changes may be made without departing from the scope of the various embodiments of the present disclosure. The following detailed description is, therefore, not to be taken in a limiting sense.

As used herein, an element or step recited in the singular and proceeded with the word "a" or "an" should be understood as not excluding the plural of the elements or steps, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Referring to FIGS. 1-11, conformable sealing eartips 100, 100*a*, 100*b*, 200 are shown. The conformable sealing eartips 100, 100*a*, 100*b*, 200 may include an eartip body 110, 110*a*, 110*b*, 210 and at least one flange 120, 120*a*, 120*b*, 130, 130*a*, 130*b*, 220. The eartip body 110, 110*a*, 110*b*, 210 may include an ear insertion end 112, 212 and an earphone insertion end 114, 214 opposite the ear insertion end 112, 212. The eartip body 110, 110*a*, 110*b*, 210 includes a central opening 116, 216 extending from the ear insertion end 112, 212 to the earphone insertion end to form an inner sound channel. The inner sound channel may be configured to receive a sound tube of an earphone. For example, the inner sound channel may be shaped to receive a sound tube of an earphone at a particular position and/or orientation. As an example, the central opening 116 may include a portion 116*a* for receiving a head of an earphone tube and a portion 116*b* for receiving a body of the earphone tube.

In an exemplary embodiment, the at least one flange 120, 120*a*, 120*b*, 130, 130*a*, 130*b*, 220 may be one flange 220 or preferably two flanges 120, 120*a*, 120*b*, 130, 130*a*, 130*b*. In the two-flange embodiment shown in FIGS. 1-8, 10, and 11, the eartip 100, 100*a*, 100*b* may include a front flange 120, 120*a*, 120*b* and a rear flange 130, 130*a*, 130*b*. The front flange 120, 120*a*, 120*b* may have a first diameter and may extend at a first angle from the eartip body 110, 110*a*, 110*b* at the ear insertion end 112. The rear flange 130, 130*a*, 130*b* may have a second diameter and may extend at a second angle from the eartip body 110, 100*a*, 110*b* toward the earphone insertion end 114. The first diameter of the front flange 120, 120*a*, 120*b* may be smaller than the second diameter of the rear flange 130, 130*a*, 130*b*. The difference between the first diameter of the front flange 120, 120*a*, 120*b* and the second diameter of the rear flange 130, 130*a*, 130*b* may be approximately 1 millimeter or less (e.g., less than 1.25 millimeters). The slightly different diameters of the front 120, 120*a*, 120*b* and rear 130, 130*a*, 130*b* flanges provide a small taper (defined as a taper angle of 5-7 degrees) that mimics the taper of a typical or nominal ear canal, providing a higher degree of probability of achieving a sealing fit in an ear canal at both flanges 120, 120*a*, 120*b*, 130, 130*a*, 130*b*. For example, three-flange eartips known in the art include three-flanges having increasing diameters so that the eartips may fit different-sized ear canals. However, the one-size-fits-all three-flange eartip provides a large taper that reduces the likelihood that a seal will be formed on more than one flange. Moreover, the large difference in diameters between the three-flanges may prevent a user from achieving a comfortable fit at a desired insertion depth.

Figure 8:
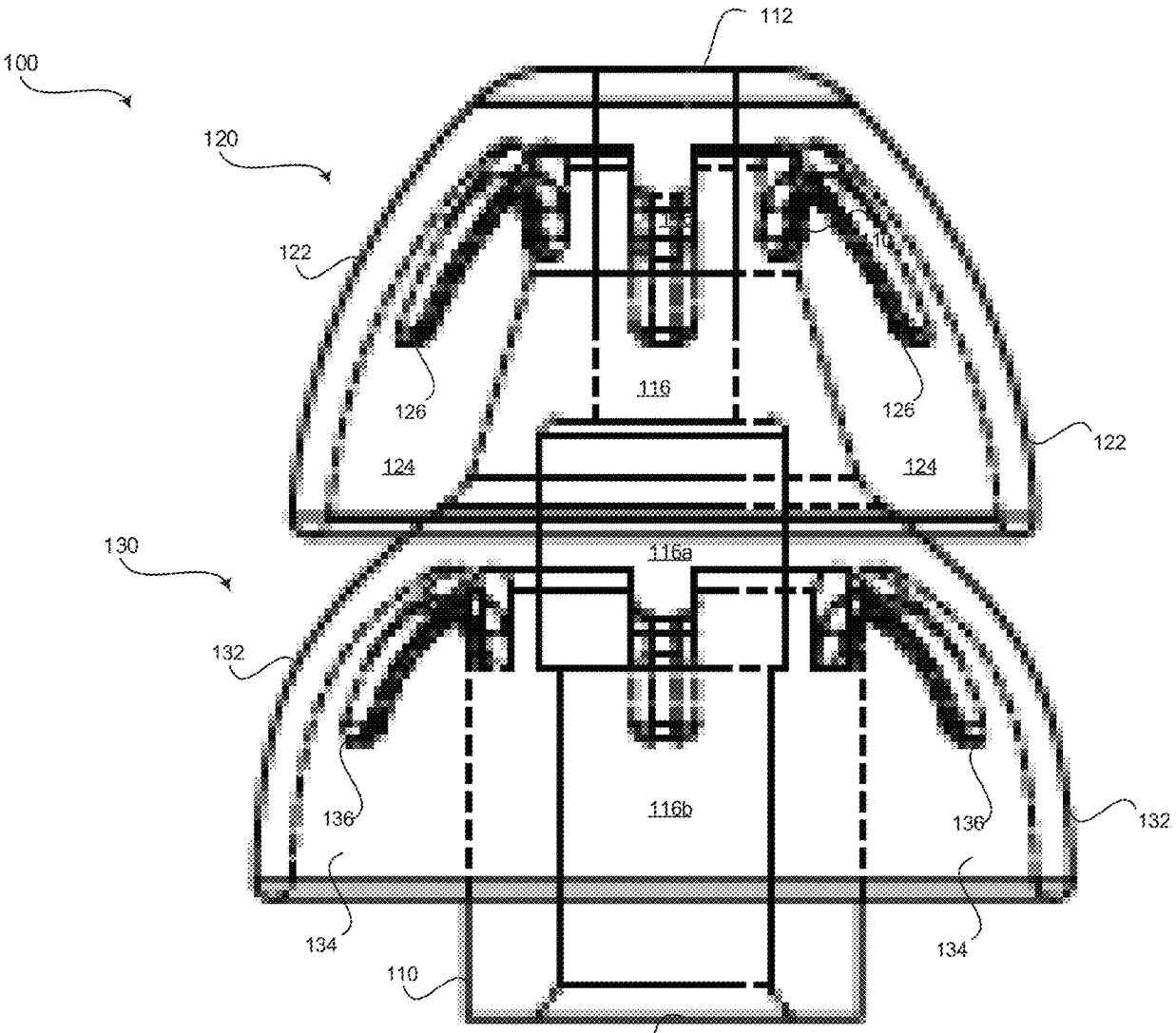
FIG. 8 depicts a semi-transparent side elevation view of an exemplary two-flange conformable sealing eartip having ribs formed on an interior surface of the front and rear flanges, in accordance with various embodiments.
Figure 9:
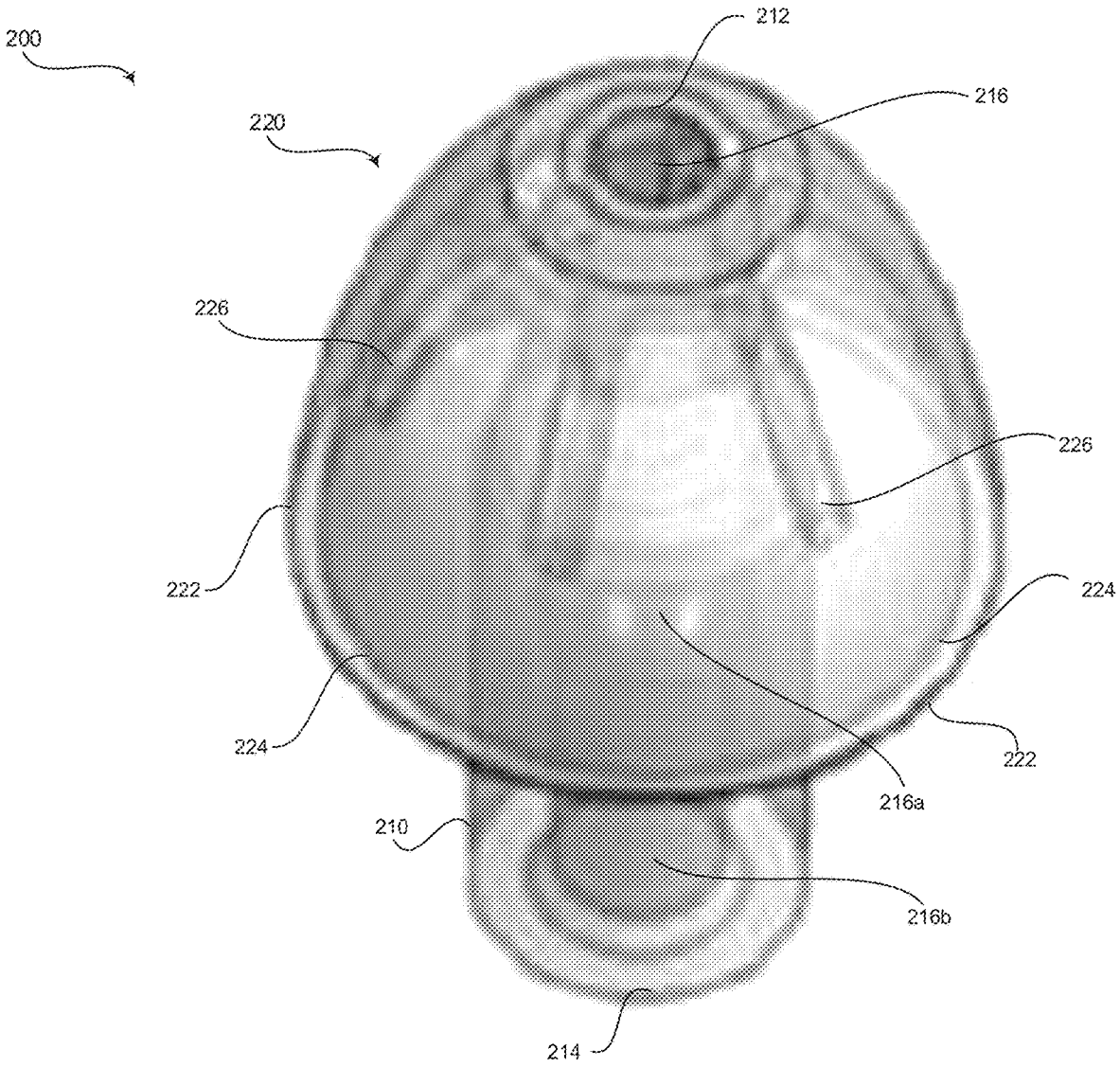
FIG. 9 depicts a semi-transparent perspective view of an exemplary one-flange conformable sealing eartip having ribs formed on an interior surface of the flange, in accordance with various embodiments.
Figure 10:
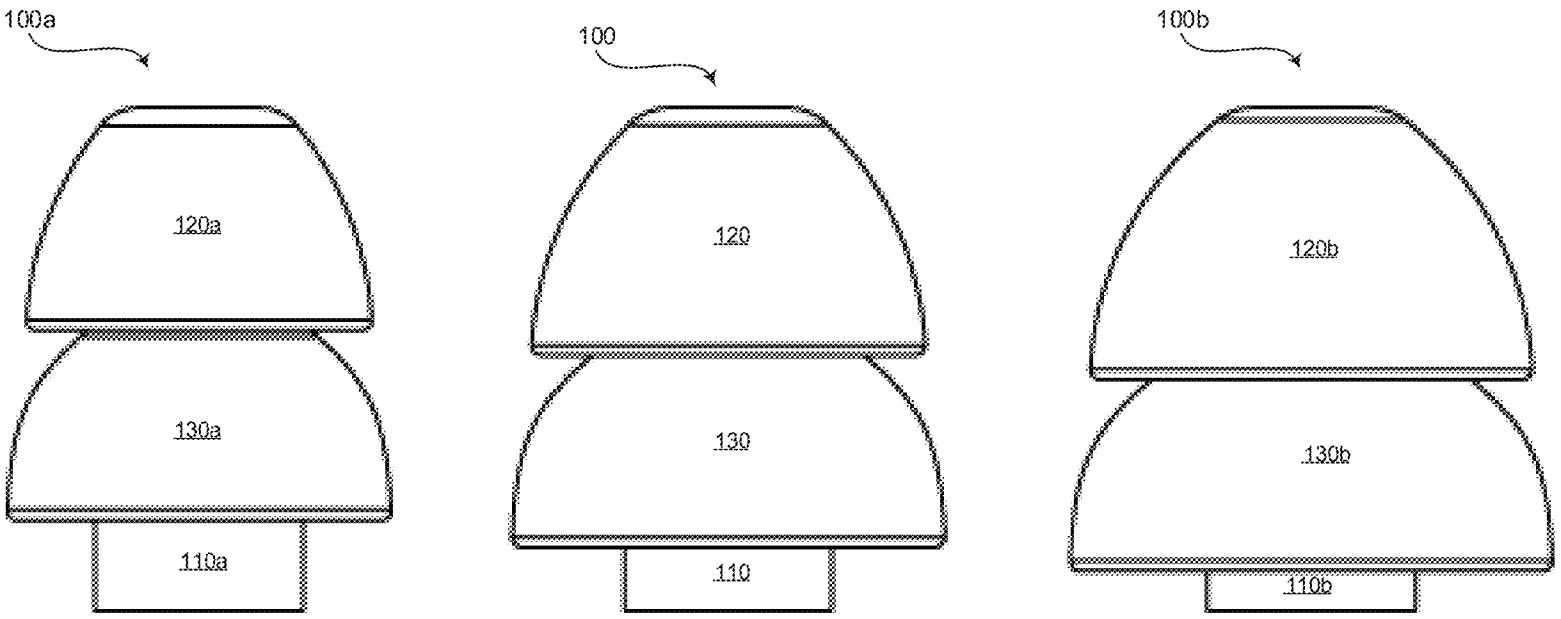
FIG. 10 depicts side elevation views of exemplary two-flange conformable sealing eartips of different sizes and having ribs formed on an interior surface of one or both flanges, in accordance with various embodiments.
Figure 11:
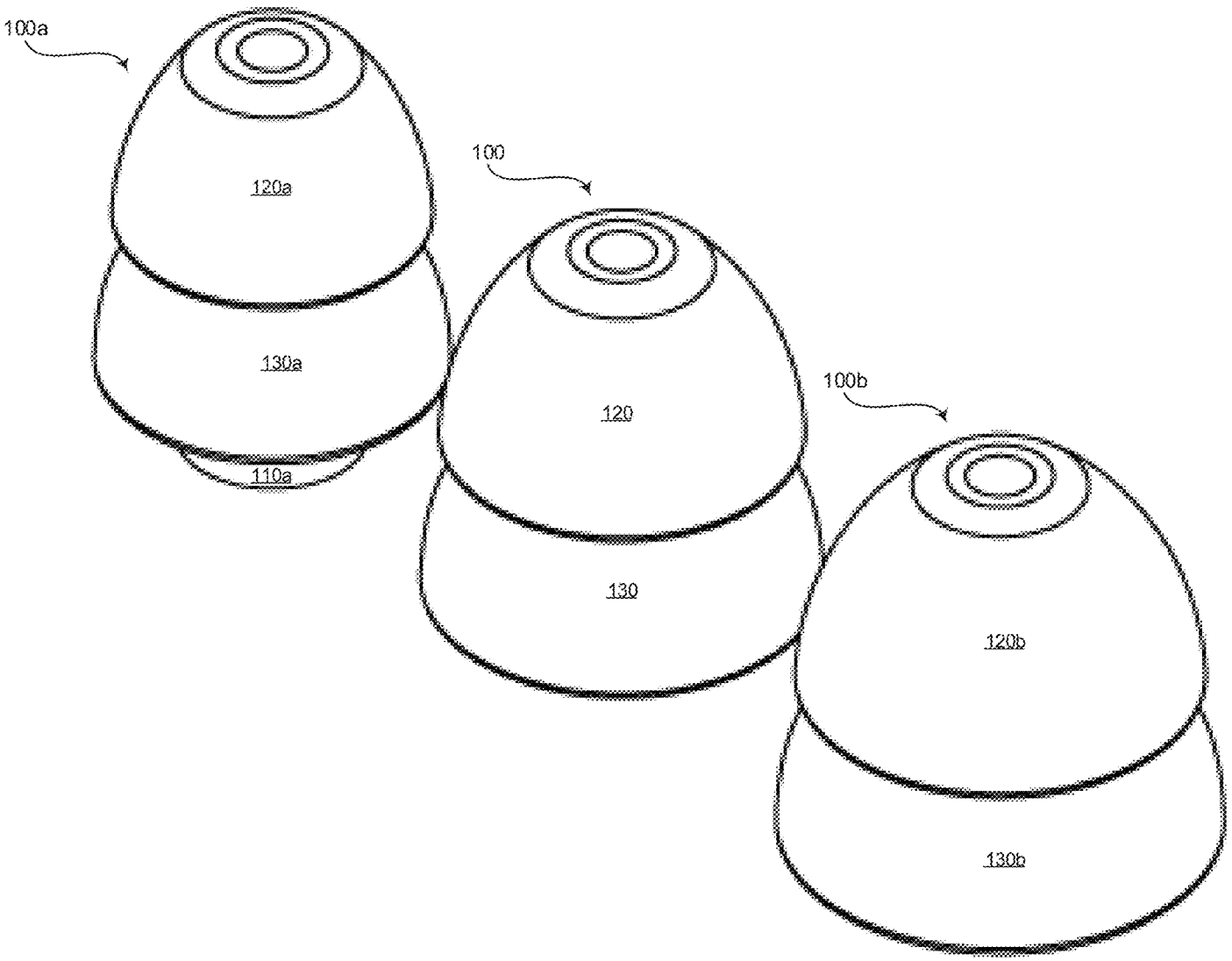
FIG. 11 depicts top, side perspective views of exemplary two-flange conformable sealing eartips of different sizes and having ribs formed on an interior surface of one or both flanges, in accordance with various embodiments.

In various embodiments, the eartips 100, 100*a*, 100*b*, 200 may be provided in different sizes, such as extra-large, large, medium, and small. As an example, the extra-large eartip may have a front flange diameter of approximately 12 millimeters (i.e., 11.5-12.5 millimeters) and a rear flange diameter of approximately 13 millimeters (i.e., 12.5-13.5 millimeters). The large eartip 100*b* shown in FIGS. 10 and 11, may have a front flange 120*b* diameter of approximately 11 millimeters (i.e., 10.5-11.5 millimeters) and a rear flange 130*b* diameter of approximately 12 millimeters (i.e., 11.5-12.5 millimeters). The medium eartip 100 shown in FIGS. 1-8, 10, and 11, may have front flange 120 diameter of approximately 10 millimeters (i.e., 9.5-10.5 millimeters) and a rear flange 130 diameter of approximately 11 millimeters (i.e., 10.5-11.5 millimeters). The small eartip 100*a* shown in FIGS. 10 and 11 may have a front flange 120*a* diameter of approximately 9 millimeters (i.e., 8.5-9.5 millimeters) and a rear flange 130*a* diameter of approximately 10 millimeters (i.e., 9.5-10.5 millimeters). Although four eartip sizes are discussed above, more or less eartip sizes having different front 120, 120*a*, 120*b* and rear 130, 130*a*, 130*b* flange diameters are contemplated. For example, FIGS. 10 and 11 illustrate eartips 100, 100*a*, 100*b* in three eartip sizes. As discussed below, certain embodiments provide a one-flange embodiment 200 that includes the front flange 220 as shown in FIG. 9.

Still referring to the two-flange embodiment 100, 100*a*, 100*b* of FIGS. 1-8, 10, and 11, the first angle between the body 110, 110*a*, 110*b* and the front flange 120, 120*a*, 120*b* may be smaller than the second angle between the body 110, 110*a*, 110*b* and the rear flange 130, 130*a*, 130*b* such that the sealing outer surfaces 122, 132 of the front 120, 120*a*, 120*b* and rear 130, 130*a*, 130*b* flanges are in close proximity with each other. For example, the distance between the ends nearest the earphone insertion end 114 of the front flange 120, 120*a*, 120*b* and the rear flange 130, 130*a*, 130*b* may be approximately 4.8 millimeters (defined as 4.6 millimeters to 5.4 millimeters). In certain embodiments, the first angle may be approximately 32 degrees (defined as between 26 and 36 degrees) and the second angle may be approximately 40 degrees (defined as between 34 and 44 degrees).

Figure 7:
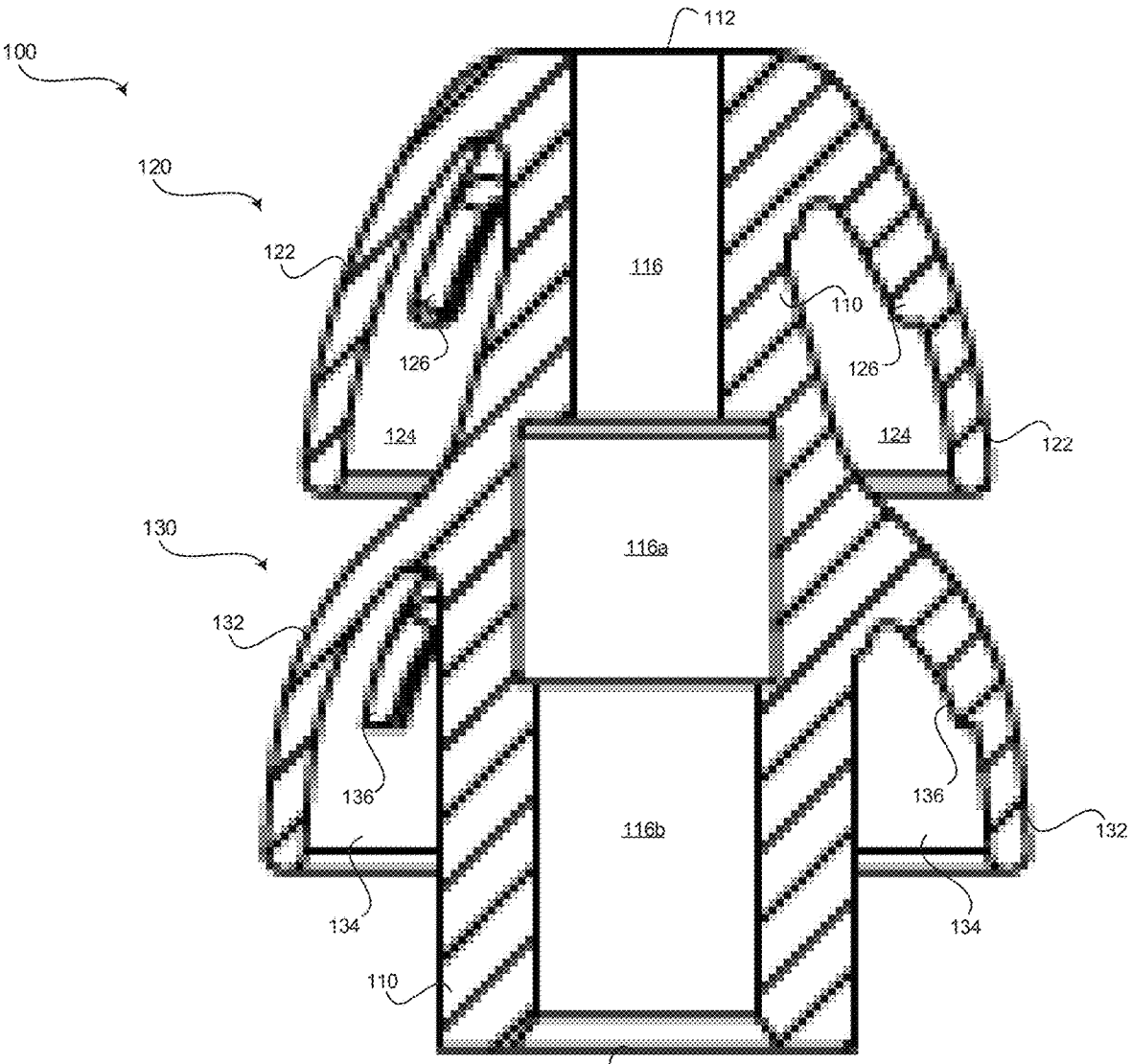
FIG. 7 depicts a side cross-sectional view of an exemplary two-flange conformable sealing eartip having ribs formed on an interior surface of the front and rear flanges, in accordance with various embodiments.

The front 120, 120*a*, 120*b* and rear 130, 130*a*, 130*b* flanges include an outer surface 122, 132 and an inner surface 124, 134. The outer surface 122, 132 of the flanges 120, 120*a*, 120*b*, 130, 130*a*, 130*b* provides the sealing surface with an ear canal of a user. In various embodiments, the inner surface 124, 134 of one or both of the front 120, 120*a*, 120*b* and rear 130, 130*a*, 130*b* flanges includes a plurality of ribs 126, 136. For example, at least FIGS. 7 and 8 illustrate ribs 126, 136 on the inner surface 124, 134 of both the front 120, 120*a*, 120*b* and rear 130, 130*a*, 130*b* flanges. As another example, at least FIGS. 2-6 illustrate ribs 136 on the inner surface 134 of the rear 130, 130*a*, 130*b* flange. The ribs 126, 136 are protrusions that may begin at an outside surface of the eartip body 110, 110*a*, 110*b*, continue around the angle between the outside surface of the eartip body 110, 110*a*, 110*b* and the inner surface 124, 132 of the flange 120, 120*a*, 120*b*, 130, 130*a*, 130*b*, and continue at least a portion toward the outer edge of the flange 120, 120*a*, 120*b*, 130, 130*a*, 130*b*. The rib protrusions 126, 136 may have a length that is greater than its width. The plurality of ribs 126, 136 may be evenly spaced about the inner surface 124, 134 of the flange 120, 120*a*, 120*b*, 130, 130*a*, 130*b* as shown at least in FIG. 4. In various embodiments, the plurality of ribs 126, 136 on each of the inner surfaces 124, 134, 224 of the one or more flanges 120, 120*a*, 120*b*, 130, 130*a*, 130*b*, 220 may be 5 or 6 ribs as shown at least in FIG. 4.

In a representative embodiment, the plurality of ribs 126, 136, 226 may be integrated into the flange 120, 120*a*, 120*b*, 130, 130*a*, 130*b*, 220 such that the ribs 126, 136, 226 have a thickness that is greater than the thickness of the flange wall 120, 120*a*, 120*b*, 130, 130*a*, 130*b*, 220. For example, the flange walls 120, 120*a*, 120*b*, 130, 130*a*, 130*b*, 220 may be thin walls constructed from a low-durometer (i.e., in the range of 25 to 45 Shore A) elastomer to allow the flange walls 120, 120*a*, 120*b*, 130, 130*a*, 130*b*, 220 to be highly conformable. The thin wall may make the flange 120, 120*a*, 120*b*, 130, 130*a*, 130*b*, 220 more likely to fold in on itself, particularly the rear flange 130, 130*a*, 130*b* having the larger second angle. The flange wall 120, 120*a*, 120*b*, 130, 130*a*, 130*b*, 220 may not provide a sealing fit if the flange wall 120, 120*a*, 120*b*, 130, 130*a*, 130*b*, 220 folds in on itself because gaps may form at the folds. The rib protrusions 126, 136, 226 may provide support to prevent the flange wall 120, 120*a*, 120*b*, 130, 130*a*, 130*b*, 220 from folding in on itself. In the one-flange embodiment, the front flange 220 includes the ribs 226 on the inside surface 224 of the flange 220. In the two-flange embodiment, at least the rear flange 130, 130*a*, 130*b*, if not both the front 120, 120*a*, 120*b* and rear 130, 130*a*, 130*b* flanges, includes the ribs 126, 136 on the inside surface 124, 134 of the flange 120, 120*a*, 120*b*, 130, 130*a*, 130*b*. In an exemplary embodiment, the front 120, 120*a*, 120*b*, 220 and rear 130, 130*a*, 130*b* flange walls may have a thickness of approximately 0.5 millimeters (defined as 0.4 to 0.6 millimeters). The ribs 126, 136, 226 may protrude from the inner surface 124, 134, 224 of the flange walls 120, 120*a*, 120*b*, 130, 130*a*, 130*b*, 220 to add an additional approximately 0.25 millimeters of thickness (defined as 0.15-0.35 millimeters). In various embodiments, the thickness of the flange walls 120, 120*a*, 120*b*, 130, 130*a*, 130*b*, 220 and/or ribs 126, 136, 226 may not be constant. In certain embodiments, the thickness of the ribs 126, 136, 226 may be based at least in part on the width of the ribs 126, 136, 226.

In the one-flange embodiment, the eartip 200 may include a front flange 220 including an outer surface 222 and an inner surface 224. The front flange 220 of the one-flange embodiment 200 may share various characteristics with the front flange 120, 120*a*, 120*b* of the two-flange embodiment 100, 100*a*, 100*b* discussed above. The outer surface 222 of the front flange 220 provides the sealing surface with an ear canal of a user. The inner surface 224 includes a plurality of ribs 226 that are protrusions that may begin at an outside surface of the eartip body 210, continue around the angle between the outside surface of the eartip body 210 and the inner surface 224 of the flange 220, and continue at least a portion toward the outer edge of the flange 220. The rib protrusions 226 may have a length that is greater than its width. The plurality of ribs 226 may be evenly spaced about the inner surface 224 of the front flange 220. The plurality of ribs 226 may be integrated into the flange 220 such that the ribs 226 have a thickness that is greater than the thickness of the flange wall 220 as described above. The eartip 200 may be provided in any suitable number of sizes as described above with respect to the two-flange embodiment 100, 100*a*, 100*b* and as illustrated in FIGS. 10 and 11.

Aspects of the present disclosure provide a low-durometer (i.e., in the range of 25 to 45 Shore A) elastomer material eartip 100, 100*a*, 100*b* with one or two thin and highly conformable sealing flanges 120, 120*a*, 120*b*, 130, 130*a*, 130*b*, 220. In an exemplary two-flange embodiment, the eartip 100, 100*a*, 100*b* includes two sealing surfaces 122, 132 located a short distance (e.g., approximately 4.8 millimeters) apart on the lengthwise aspect of the eartip 100, 100*a*, 100*b*, regardless of eartip flange 120, 120*a*, 120*b*, 130, 130*a*, 130*b* diameter. The close proximity of the sealing surfaces 122, 132 increase the likelihood of sealing the ear canal with shallower insertion depths. The close proximity also increases the probability of having a seal created by both flanges 120, 120*a*, 120*b*, 130, 130*a*, 130*b*, which would provide a greater exclusion of external sound.

Various embodiments provide an integral structural support 126, 136, 226 to one or both flanges 120, 120*a*, 120*b*, 130, 130*a*, 130*b*, 220 that minimizes the likelihood of the flange 120, 120*a*, 120*b*, 130, 130*a*, 130*b*, 220 folding in on itself and thus eliminating the seal to the ear canal wall, while maintaining the conformable and comfortable thin wall on the flange 120, 120*a*, 120*b*, 130, 130*a*, 130*b*, 220. The structural rib members 126, 136, 226 molded into the underside 124, 134, 224 of the flange(s) 120, 120*a*, 120*b*, 130, 130*a*, 130*b*, 220 provide sufficient integrity to the flange 120, 120*a*, 120*b*, 130, 130*a*, 130*b*, 220 without negatively reducing the comfort or tendency of the flange 120, 120*a*, 120*b*, 130, 130*a*, 130*b*, 220 to seal against the ear canal wall.

In certain embodiments, the thin walls of the flange(s) 120, 120*a*, 120*b*, 130, 130*a*, 130*b*, 220, when molded using a low-durometer elastomer (e.g., silicone), provide less resistance to trapped pressurized air escaping around the flange 120, 120*a*, 120*b*, 130, 130*a*, 130*b*, 220 as it is inserted into the ear canal, reducing the likelihood of causing an uncomfortable pressure build-up.

Aspects of the present disclosure provide an eartip 100, 100*a*, 100*b*, 200. The eartip 100, 100*a*, 100*b*, 200 may comprise a body 110, 110*a*, 110*b*, 210 and one or more flanges 120, 120*a*, 120*b*, 130, 130*a*, 130*b*, 220 extending from the body 110, 110*a*, 110*b*, 210. The body 110, 110*a*, 110*b*, 210 may comprise an ear insertion end 112, 212, an earphone insertion end 114, 214 opposite the ear insertion end 112, 212, and a central opening 116, 216 extending between the ear insertion end 112, 212 and the earphone insertion end 114, 214 to form an inner sound channel through the body 110, 110*a*, 110*b*, 210. The one or more flanges 120, 120*a*, 120*b*, 130, 130*a*, 130*b*, 220 may extend from the body 110, 110*a*, 110*b*, 210 and may comprise an outer sealing surface 122, 132, 222 and an inner surface 124, 134, 224. At least one of the one or more flanges 120, 120*a*, 120*b*, 130, 130*a*, 130*b*, 220 may comprise a plurality of ribs 126, 136, 226 protruding from the inner surface 124, 134, 224 of the at least one of the one or more flanges 120, 120*a*, 120*b*, 130, 130*a*, 130*b*, 220.

In an exemplary embodiment, the one or more flanges 120, 120*a*, 120*b*, 130, 130*a*, 130*b*, 220 may be two flanges 120, 120*a*, 120*b*, 130, 130*a*, 130*b* comprising a front flange 120, 120*a*, 120*b* and a rear flange 130, 130*a*, 130*b*. In a representative embodiment, the plurality of ribs 136 may protrude from the inner surface 134 of at least the rear flange 130, 130*a*, 130*b*. In various embodiments, the front flange 120, 120*a*, 120*b* may extend from the ear insertion end 112 of the body 110, 110*a*, 110*b* at a first angle and the rear flange 130, 130*a*, 130*b* may extend from the body 110, 110*a*, 110*b* toward the earphone insertion end 114 at a second angle that is greater than the first angle. In certain embodiments, a distance between the front flange 120, 120*a*, 120*b* extending from the body 110, 110*a*, 110*b* and the rear flange 130, 130*a*, 130*b* extending from the body 110, 110*a*, 110*b* may be 4.6 to 5.4 millimeters. In an exemplary embodiment, the first angle is 26 to 36 degrees. In a representative embodiment, the second angle is 34 to 44 degrees. In various embodiments, the front flange 120, 120*a*, 120*b* may include a first diameter and the rear flange 130, 130*a*, 130*b* may include a second diameter that is larger than the first diameter. In certain embodiments, a difference between the first diameter and the second diameter is less than 1.25 millimeters. In an exemplary embodiment, a taper angle of the eartip 100, 100*a*, 100*b* defined by the first diameter and the second diameter is 5 to 7 degrees.

In a representative embodiment, each of the plurality of ribs 126, 136, 226 may be a protrusion that extends from an outside surface of the body 110, 110*a*, 110*b*, 210, around a corner between the outside surface of the body 110, 110*a*, 110*b*, 210 and the inner surface 124, 134, 224 of the at least one of the one or more flanges 120, 120*a*, 120*b*, 130, 130*a*, 130*b*, 220, and continues along the inner surface 124, 134, 224 of the at least one of the one or more flanges 120, 120*a*, 120*b*, 130, 130*a*, 130*b*, 220 at least a portion toward an outer edge of the at least one of the one or more flanges 120, 120*a*, 120*b*, 130, 130*a*, 130*b*, 220. In various embodiments, each of the plurality of ribs 126, 136, 226 may comprise a length and a width. The length may be greater than the width. In certain embodiments, the plurality of ribs 126, 136, 226 may be evenly spaced about the inner surface 124, 134, 224 of the at least one of the one or more flanges 120, 120*a*, 120*b*, 130, 130*a*, 130*b*, 220. In an exemplary embodiment, the plurality of ribs 126, 136, 226 may be 5 or 6 ribs on the inner surface 124, 134, 224 of each of the at least one of the one or more flanges 120, 120*a*, 120*b*, 130, 130*a*, 130*b*, 220. In a representative embodiment, a thickness of each of the one or more flanges 120, 120*a*, 120*b*, 130, 130*a*, 130*b*, 220 may be 0.4 to 0.6 millimeters. In various embodiments, an amount of protrusion of each of the plurality of ribs 126, 136, 226 from the inner surface 124, 134, 224 of the at least one of the one or more flanges 120, 120*a*, 120*b*, 130, 130*a*, 130*b*, 220 may be 0.15 to 0.35 millimeters. In certain embodiments, the amount of protrusion of each of the plurality of ribs 126, 136, 226 from the inner surface 124, 134, 224 may be based on a length of a respective one of the plurality of ribs 126, 136, 226. In an exemplary embodiment, a thickness of each of the one or more flanges 120, 120*a*, 120*b*, 130, 130*a*, 130*b*, 220 and/or an amount of protrusion of each of the plurality of ribs 126, 136, 226 from the inner surface 124, 134, 224 may not be constant. In a representative embodiment, the central opening 116, 216 of the body 110, 110*a*, 110*b*, 210 may comprise at least one portion 116*a*, 116*b*, 216*a*, 216*b* at the earphone insertion end 114, 214 shaped to receive a sound tube of an earphone at a pre-defined positon. In various embodiments, the eartip 100, 100*a*, 100*b*, 200 may be an elastomer material having a durometer of 25 to 45 Shore A.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, a component is "operable" or "configured" to perform a function whenever the component comprises the necessary structure to perform the function, regardless of whether the function is performed.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed.

What is claimed is:

1. An eartip comprising:

a body comprising:

an ear insertion end, an earphone insertion end opposite the ear insertion end, an outside surface, and an inside surface defining a central opening extending between the ear insertion end and the earphone insertion end to form an inner sound channel through the body; and a front flange and a rear flange, each extending from the body and comprising an outer sealing surface and an inner surface, wherein only the rear flange comprises a plurality of ribs, each of the plurality of ribs is a protrusion that extends along a portion of the inner surface of the rear flange, around a corner between the inner surface of the rear flange and the outside surface of the body, and onto a portion of the outside surface of the body.

2. The eartip of claim 1, wherein the front flange extends from the ear insertion end of the body at a first angle and the rear flange extends from the body toward the earphone insertion end at a second angle that is greater than the first angle.

3. The eartip of claim 2, wherein a distance between the front flange extending from the body and the rear flange extending from the body is 4.6 to 5.4 millimeters.

4. The eartip of claim 2, wherein the first angle is 26 to 36 degrees.

5. The eartip of claim 2, wherein the second angle is 34 to 44 degrees.

6. The eartip of claim 1, wherein the front flange includes a first diameter and the rear flange includes a second diameter that is larger than the first diameter.

7. The eartip of claim 6, wherein a difference between the first diameter and the second diameter is less than 1.25 millimeters.

8. The eartip of claim 6, wherein a taper angle of the eartip defined by the first diameter and the second diameter is 5 to 7 degrees.

9. The eartip of claim 1, wherein each of the plurality of ribs comprises a length and a width, wherein the length is greater than the width.

10. The eartip of claim 1, wherein the plurality of ribs are evenly spaced about the inner surface of the rear flange.

11. The eartip of claim 1, wherein the plurality of ribs are 5 or 6 ribs on the inner surface of the rear flange.

12. The eartip of claim 1, wherein a thickness of each of the front flange and the rear flange is 0.4 to 0.6 millimeters.

13. The eartip of claim 1, wherein an amount of protrusion of each of the plurality of ribs from the inner surface of the rear flange is 0.15 to 0.35 millimeters.

14. The eartip of claim 13, wherein the amount of protrusion of each of the plurality of ribs from the inner surface is based on a length of a respective one of the plurality of ribs.

15. The eartip of claim 1, wherein a thickness of each of the front flange and the rear flange and/or an amount of protrusion of each of the plurality of ribs from the inner surface of the rear flange is not constant.

16. The eartip of claim 1, wherein the central opening of the body comprises at least one portion at the earphone insertion end shaped to receive a sound tube of an earphone at a pre-defined positon.

17. The eartip of claim 1, wherein the eartip is an elastomer material having a durometer of 25 to 45 Shore A.

* * * * *